United States Patent [19]

Bowden

[11] Patent Number: 4,766,916

[45] Date of Patent: Aug. 30, 1988

[54] CONTINUOUS CONVEYOR DEGREASING AND CLEANING MACHINE

[76] Inventor: Donald R. Bowden, 8707 Valleyview Dr., Huntsville, Ala. 35802

[21] Appl. No.: 933,159

[22] Filed: Nov. 21, 1986

[51] Int. Cl.[4] ..... B08B 3/02

[52] U.S. Cl. ..... 134/109; 134/130; 134/131; 134/199

[58] Field of Search ..... 134/64 R, 73, 74, 99, 134/122 R, 130, 131, 109, 199; 68/158

[56] References Cited

U.S. PATENT DOCUMENTS

| | | | |
|---|---|---|---|
| Re. 28,174 | 9/1974 | Sabatka | 134/130 |
| 2,322,777 | 6/1943 | Purnell | 134/124 |
| 2,385,860 | 10/1945 | Jesson | 134/124 |
| 2,989,027 | 6/1961 | Schown . | |
| 3,164,656 | 1/1965 | Ipsen | 134/130 |
| 3,242,933 | 3/1966 | Huff | 134/130 |
| 3,311,039 | 3/1967 | Lucas | 134/124 |
| 3,868,272 | 2/1975 | Tardoskegyi | 134/26 |
| 4,087,993 | 5/1978 | Sando et al. | 68/158 |
| 4,092,991 | 6/1978 | Rohrs | 134/127 |
| 4,256,168 | 3/1981 | Hein et al. | 134/122 R |
| 4,498,934 | 2/1985 | Potts | 134/74 |
| 4,651,762 | 3/1987 | Bowden | 134/111 |

*Primary Examiner*—Harvey C. Hornsby
*Assistant Examiner*—C. Reinckens
*Attorney, Agent, or Firm*—Dowell & Dowell

[57] ABSTRACT

A degreasing and cleaning machine for removing grease, oils and other substances or residues from the surfaces of machine parts and/or various articles of manufacture which includes a porous and continuous transporting conveyor having a section which extends through a chamber so as to be completely submerged in a cleaning solution and wherein flow controllers cycle a major portion of the cleaning solution through vertically spaced headers so as to direct the solution toward both the upper and lower sides of the transporting conveyor while minor portions of the solution are simultaneously passed through a non-turbulent skimmer chamber wherein greases, oils and other residues are continuously removed from the cleaning solution.

22 Claims, 4 Drawing Sheets

CONTINUOUS CONVEYOR DEGREASING AND CLEANING MACHINE

BACKGROUND OF THE INVENTION

1. Field of the Invention

This invention is generally directed to cleaning machines and more specifically to continuous conveyor type cleaning and degreasing machines which may be utilized to remove greases, oils, tars and various other residues from machinery parts, tools and articles of manufacture. The machine includes a parts transporting conveyor which carries the articles to be cleaned through a cleaning chamber filled with a cleaning solution and wherein the articles or parts are subjected to a series of opposing torrents of cleaning solution. The turbulent flow and agitation achieved by the flow of solution insures that substantially all of the oils, greases and other residues are removed from the parts or articles. The degreasing and cleaning machine is not only continuously operable, but the cleaning solution is also continuously purified by being passed through a non-turbulent containment chamber which is in fluid communication with the cleaning chamber and wherein greases, oils and other contaminants are separated and removed therefrom.

2. History of the Art

Industrial type cleaning machines have been used not only to remove greases, dirts, oils and residues from old machinery parts but also to clean manufactured items which have been left with oily residues as a result of the manufacturing process. Cleaning old parts or components enable such items to be rejuvenated for extended periods of additional use thereby prolonging the service life of older machines and equipment.

During the continued operation of many machines, the lubricants which are utilized to reduce friction and wear and tear of the interacting parts begin to collect or cake on such components. In addition, dirt, dust and small particles of production debris become embedded in the lubricating material causing undesireable build ups and deposits of such materials on the machine components. In some instances, in order to permit continued operation of a machine, it becomes necessary to dismantle the machine and clean the deposited materials from the various operating parts or components. This cleaning may be part of a scheduled maintenance program or may be done as part of a restoring or rebuilding program.

Various types of cleaning units have heretobefore been designed to accomodate the degreasing and cleaning of machine parts and the like. Some of these units operate as batch type cleaners wherein a single load of parts are immersed in a solvent or cleaning solution and allowed to soak over a period of time. Thereafter, the parts are withdrawn from the cleaning fluid and the fluid containing the contaminant oils and greases discharged. Such simple batch processes have the disadvantage of being both slow and inefficient as well as being costly. The costs of cleaning solvents are such that methods which require the solutions to be discharged after one or a limited number of uses cannot be practiced economically. Further, processes which provide for subsequent filtering and separation of oils and greases from discharged solvent solutions in order to reduce solvent costs require additional fluid handling equipment and are also labor intensive.

Other disadvantages in the single batch type processes are that such processes are inherently slow and not always thoroughly effective in totally or adequately cleaning the parts being treated. To improve the overall cleaning effectiveness of batch processes, use has been made of heaters to increase the temperatures of the cleaning solvents and mixers or agitators to create greater fluid turbulence. With increased solvent temperatures and increased fluid movement, not only were cleaning efficiencies improved but cleaning cycles or rates were also reduced.

In some other prior art cleaning units, use has been made of fluid sprayers to facilitate the removal of impurities from the surface of parts or components being cleaned. Such prior art sprayers are used to direct high velocity jets of cleaning fluids toward components being processed in order to dislodge materials or contaminants therefrom. The use of fluid jets or sprays has been ineffective in removing more stubborn and built up layers of grease and dirt.

Hybrid cleaning systems have also been developed which incorporate combinations of solvent sprays and batch type processing of parts being cleaned. In these systems, the parts are subjected to either or both initial and post fluid sprays while being intermittently submerged in the batch cleaning solutions. Such hybrid systems also have their disadvantages. Not only do such systems require additional parts conveying equipment but the fluid sprays cause small particles of solvent to become air borne thereby necessitating the use of special ventilation equipment to maintain the environment and air quality in the area in which such systems are used.

In order to obtain an efficient and reliable parts degreasing and cleaning machine which provides for the continuous use of the cleaning solvent, applicant designed and developed a system which is described in copending U.S. patent application, Ser. No. 750,200, filed July 1, 1985. In this system, the cleaning fluid or solution is predominantly retained and cycled through fluid headers disposed in direct communication below the surface of the fluid within the parts cleaning chamber. A small portion of the fluid being recycled to create turbulence within the part cleaning chamber is allowed to pass into a non-turbulent chamber wherein the greases, oils and other contaminants are separated by gravity and then removed by skimming the surface to remove such contaminants from the cleaning solution.

Although applicant's copending process and apparatus provides for a cleaning system which conserves solvents, the system still operates as a batch system and therefore is not always conducive for use in some types of cleaning environments.

Some other examples of the prior art degreasing and cleaning machines include U.S. Pat. Nos. 2,385,860 to Jesson, 2,989,027 to Schouw, 3,242,933 to Huff and 4,092,991 to Rohrs.

SUMMARY OF THE INVENTION

This invention is directed to a machine for cleaning and removing oils, greases and other substances from machinery parts and new articles of manufacture. The invention includes a continuous conveyor for transporting items to be cleaned through a cleaning chamber containing a cleaning solution and wherein vertically spaced fluid discharge headers are submerged within the cleaning chamber so as to be oriented in close proximity to and on opposite sides of the conveyor. The fluid headers are provided with a series of elongated fluid discharge openings through which cleaning fluid or solution is forced toward the parts conveyor. The upper fluid header may also be vertically adjusted so as to vary its vertically spaced relationship relative to the conveyor. A pair of fluid circulating components which may be in the form of propellers are positioned within the cleaning chamber so as to recycle the cleaning solution therein and force the same outwardly of the openings in the fluid discharge headers thereby creating opposing currents of subsurface flow of solvent directed against opposite sides of the parts conveyor. A small portion of the circulated cleaning solution is allowed to continuously pass into a non-turbulent separation or containment chamber wherein the greases, oils and other contaminants are allowed to separate from the cleaning solution by gravity. Thereafter, the grease and oils are removed and the processed solvent or cleaning solution passes back into the cleaning chamber.

It is the primary object of the present invention to provide a machine for cleaning and degreasing machinery parts and/or newly manufactured items which have been coated with oily residues during manufacture wherein the machine is capable of cleaning a continuous supply of parts and yet clean the parts as thoroughly as is possible using slower batch type cleaning machines.

It is another object of the present invention to provide a continuously operable parts degreasing and cleaning machine wherein the cleaning solution is constantly circulated in such a manner as to permit greases, oils and other residues to be separated thereform so that the cleaning solution remains relatively pure and will not contaminate the articles being cleaned therein.

It is also an object of the present invention to provide a cleaning and degreasing machine which utilizes a plurality of opposing subsurface high velocity streams of cleaning solution to not only create a turbulence within the cleaning chamber but to also dislodge built up dirt and oily deposits associated with the articles being cleaned.

A further object of the present invention is to provide parts degreasing and cleaning equipment which operates in a continuous manner and which incorporates flow controllers for the cleaning solution which will insure that the parts are thoroughly cleaned in a more expeditious manner than is possible using conventional cleaning and degreasing machines.

It is also an object of the present invention to provide a system for cleaning and degreasing various articles wherein the articles are subjected to total submergence in the cleaning solution while simultaneously being subjected to a plurality of opposing directionalized high pressure torrents of cleaning solution to thereby increase both the rate and the effectiveness of the cleaning process.

It is another object of the present invention to provide a degreasing and cleaning system wherein the parts to be cleaned are carried between relatively adjustable fluid headers so that varying sizes of parts may easily be accomodated and the fluid velocity selectively adjusted.

DESCRIPTION OF THE PREFERRED EMBODIMENT

Figure 1:
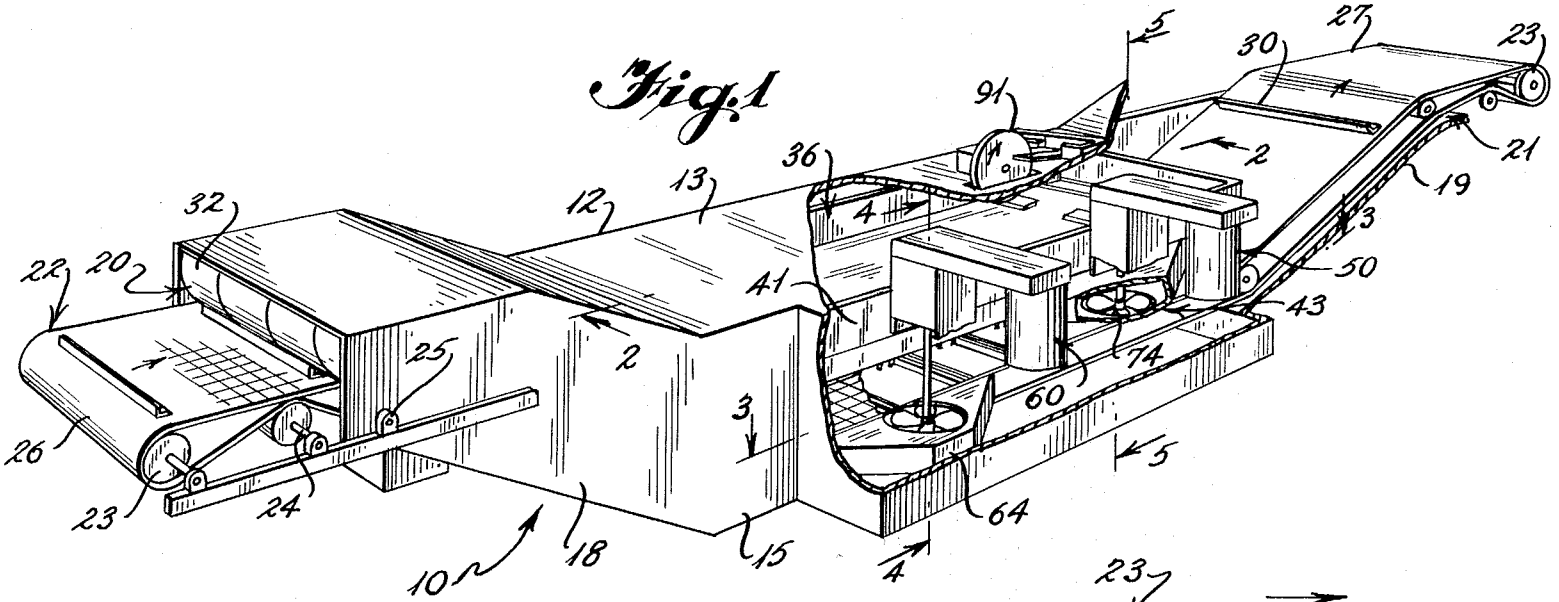
FIG. 1 is a perspective view having portions broken away of the continuous conveyor degreasing and cleaning machine of the present invention.

With continued reference to the drawings, the degreasing and cleaning machine 10 of the present invention includes an elongated housing 12 having an upper wall 13, lower wall 14 and side walls 15 and 16. The housing defines a central or intermediate fluid retention portion 17 and upwardly and outwardly inclined end sections 18 and 19, respectively. An entrance opening 20 is provided in end section 18 and an exit on discharge opening 21 is provided in end section 19.

As previously discussed, the degreasing and cleaning machine 10 is capable of handling a continuous supply or input of parts to be cleaned. In order to handle this continuous supply of parts, the machine includes an elongated continuous conveyor 22 which is preferrably of an open chain, linked belt or other porous constructions so that fluid may easily pass therethrough. The conveyor 22 is movably supported by a plurality of spaced sprockets 23 which are rotatably carried by spaced rods or shafts 24. The shafts 24 are mounted within opposing pairs of bearing block assemblies 25 which are spaced along the length of the machine. A motor (not shown) is operatively connected to one or more of the shafts 24 to thereby drive the conveyor in a continuous path and in the direction shown by the arrows in FIGS. 1 and 2.

As shown in the drawings, the conveyor includes an inlet end portion 26 which extends outwardly of the opening 20 in housing end sections 18 and a discharge portion 27 which extends outwardly of the opening 21 in housing end section 19. Inwardly of the opening 20 in the machine housing, the conveyor extends downwardly along an inclined path until leveling off along the intermediate portion 20 thereof. In a like manner, after the conveyor passes through the fluid retention central portion 17 of the housing, it inclines upwardly and outwardly through the discharge opening 21 in the machine housing. As the conveyor is continuous in construction, there are created upper and lower conveyor runs wherein the upper run serves to support parts during the degreasing and cleaning process. In operation, parts are either automatically conveyed to or are manually placed on the upper conveyor run along the inlet end portion 26 thereof. The parts are subsequently carried through the housing and removed or automatically transferred to handling equipment adjacent the discharge portion 27 of the conveyor. The parts are positively retained on the conveyor by providing a plurality of retention bars 30 which are mounted at spaced intervals across the width of the conveyor 22.

As the central portion 17 of the housing is essentially filled within a cleaning and degreasing solution or solvent, the inlet and discharge openings 20 and 21 are spaced above the central portion so that no fluid will pass outwardly thereof. Further, the openings are provided with flexible flaps 32 which prevent the solution from splashing outwardly of the housing and also limit the escape of vapors therefrom.

Figures 2, 2B, 2C:
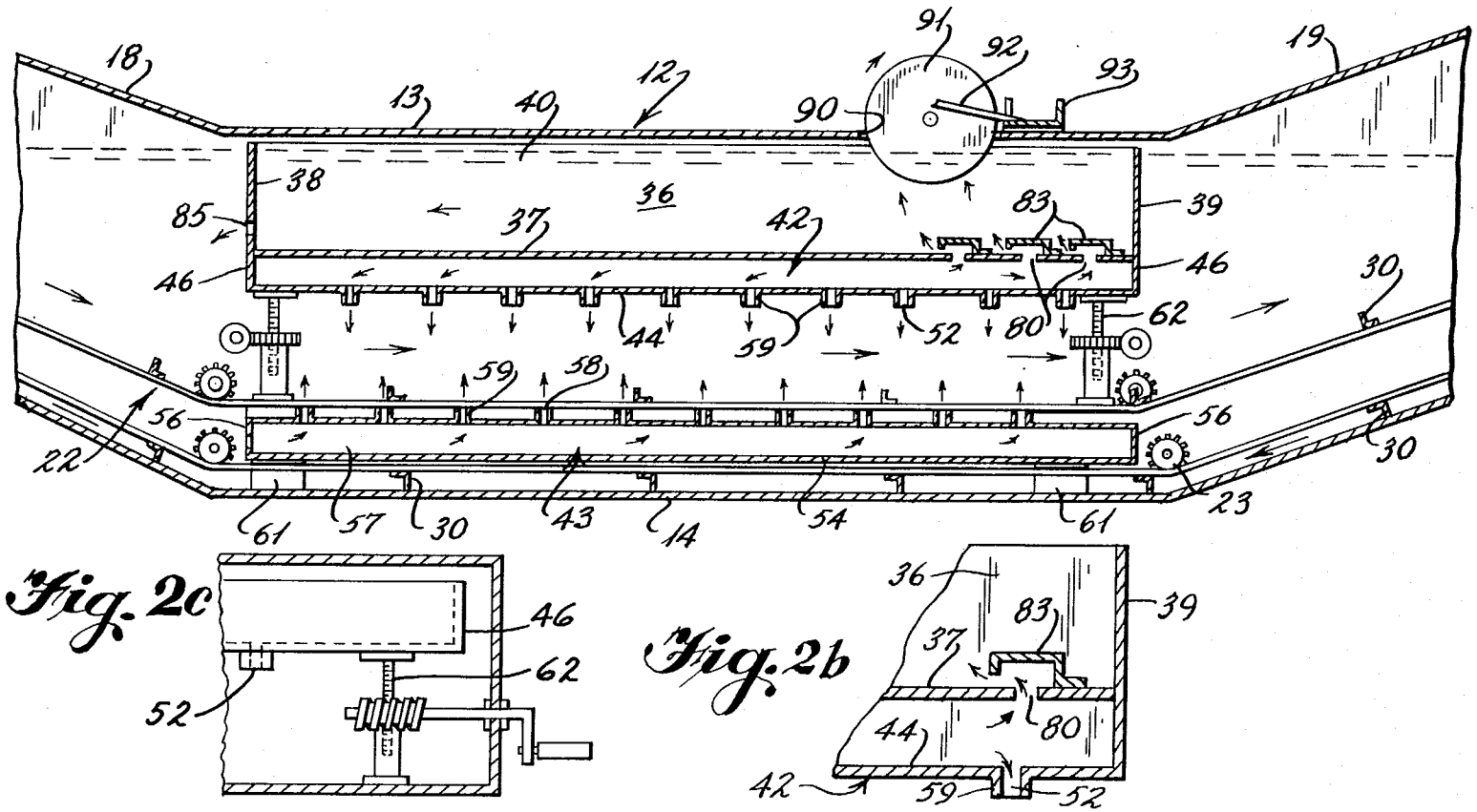
FIG. 2 is an enlarged cross sectional view taken along lines 2—2 of FIG. 1.
FIG. 2*b* is an enlarged fragmentary cross sectional view showing the fluid ports into the upper non-turbulent liquid containment chamber of the invention.
FIG. 2*c* is an enlarged fragmentary cross sectional view showing one of the adjustable standards or legs of the present invention.
Figure 3:
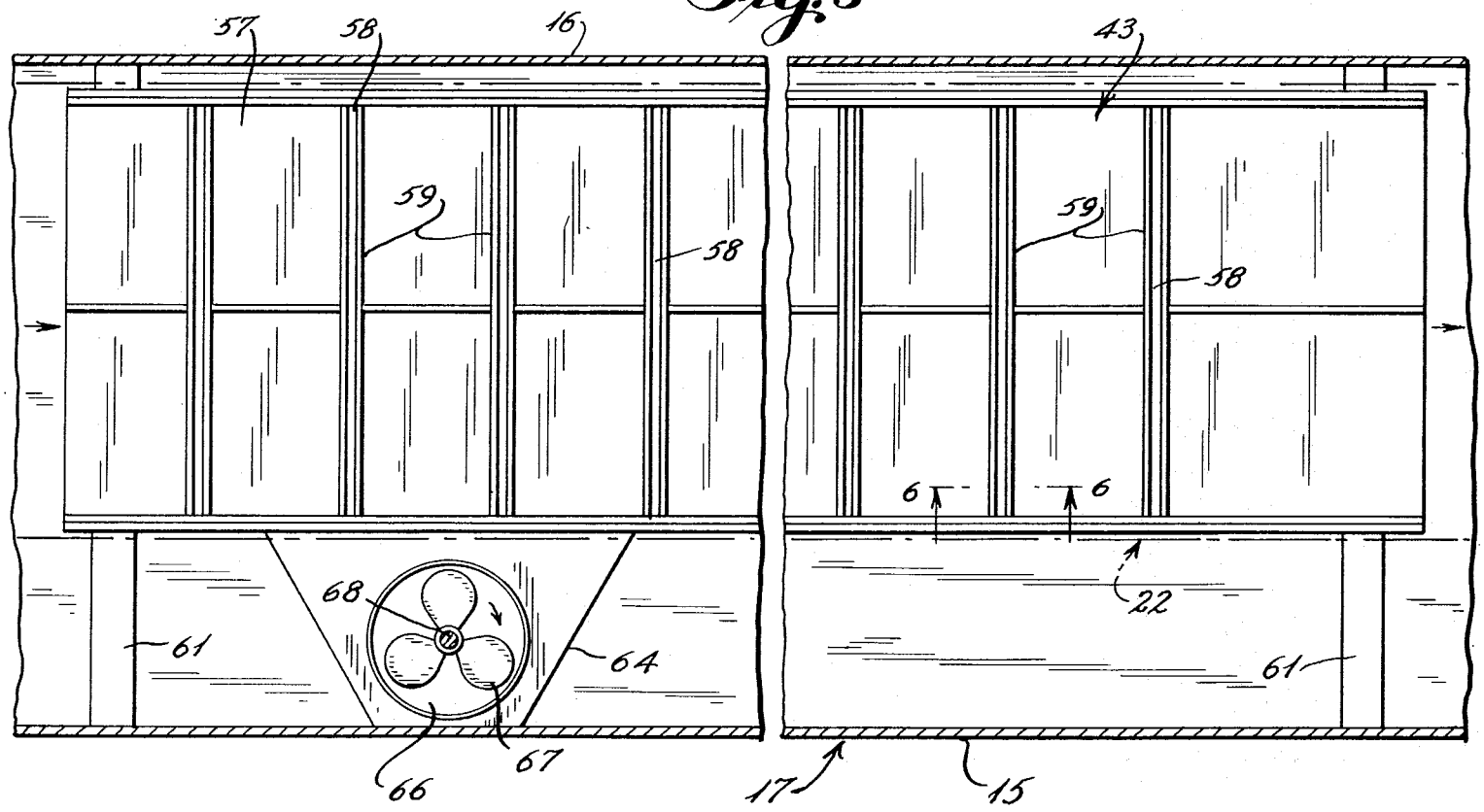
FIG. 3 is an enlarged cross section view taken along lines 3—3 of FIG. 1.

With particular reference to FIG. 2 of the drawings, the central portion of the housing defines a lower cleaning chamber 35 and an upper containment or contaminant separation chamber 36. As shown, the cleaning solution substantially fills the central portion of the housing to a level proximate to the upper wall of the housing. The upper containment chamber includes a bottom wall 37, end walls 38 and 39 and side walls 40 and 41. The top of the contamination separation chamber is open and extends slightly above the fluid level in the housing.

A pair of fluid circulating headers or plenums 42 and 43 are mounted within the cleaning chamber 35 and extend in generally spaced opposing parallel relationship with one another along substantially the entire length of the central section 17 of the housing. The upper fluid header 42 is carried by the contaminant separation chamber 36 and includes a lower wall 44 which is retained in spaced relationship below the bottom wall 37 of the separation chamber by spaced side walls 45 and end walls 46. Cleaning fluid is circulated into the upper fluid header by way of a first pump assembly 50. The majority of the fluid passes from the upper fluid header through a plurality of elongated slots or openings 52 which are provided through the lower wall 44 and which extend generally perpendicularly to the path of travel of the conveyor. The openings are spaced along substantially the entire length of the header and may be further defined by downwardly extending pairs of guide or flow directing flanges 53. In use, the openings and flanges 53 function as elongated nozzles for directing fluid outwardly from the plenum or header in directionalized high velocity currents as shown by the arrows in FIG. 2.

The lower fluid plenum or header 43 is constructed similarly to the upper header 42 and includes a bottom wall 54, side walls 55, end walls 56 and upper wall 57. A plurality of elongated slots or openings 58 are provided through the upper wall 57 and are spaced along the entire length of the lower header. The openings 58 extend perpendicularly to the path of travel of the conveyor and pairs of flanges 59 may be secured on opposite sides of each opening. Fluid is directed into the lower header by way of a second pump assembly 60.

Figure 6:
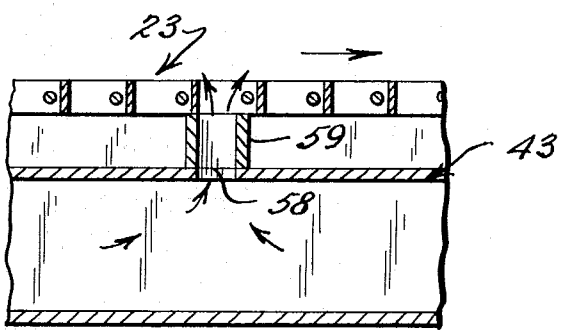
FIG. 6 is an enlarged fragmentary cross sectional view taken along lines 6—6 of FIG. 3.

As shown in FIG. 2, and in detail in FIG. 6, the upper run of the conveyor passes in close proximity to the lower header 43 so that the cleaning solution exiting through the elongated openings 58 is directed upwardly therethrough. Simultaneously, currents of cleaning solution will be directed downwardly with respect to the conveyor through the openings 52 of the upper header 42. The lower header is mounted by brackets 61 so as to be spaced from the lower wall 14 of the housing and thereby provides clearance for the return passage of the lower run of the conveyor. In order to permit the spacing between the upper header and the conveyor to be adjustable, the upper header is supported by adjustable standards or legs 62. The legs may include handle portions (see FIG. 2*c*) which lay be used to adjust interfitting threaded portions of the legs so as to selectively raise or lower the upper header relative to the conveyor and lower header. In practice, the upper header may be selectively spaced from a minimum of inches to distances exceeding a foot or more from the lower header.

Figure 4:
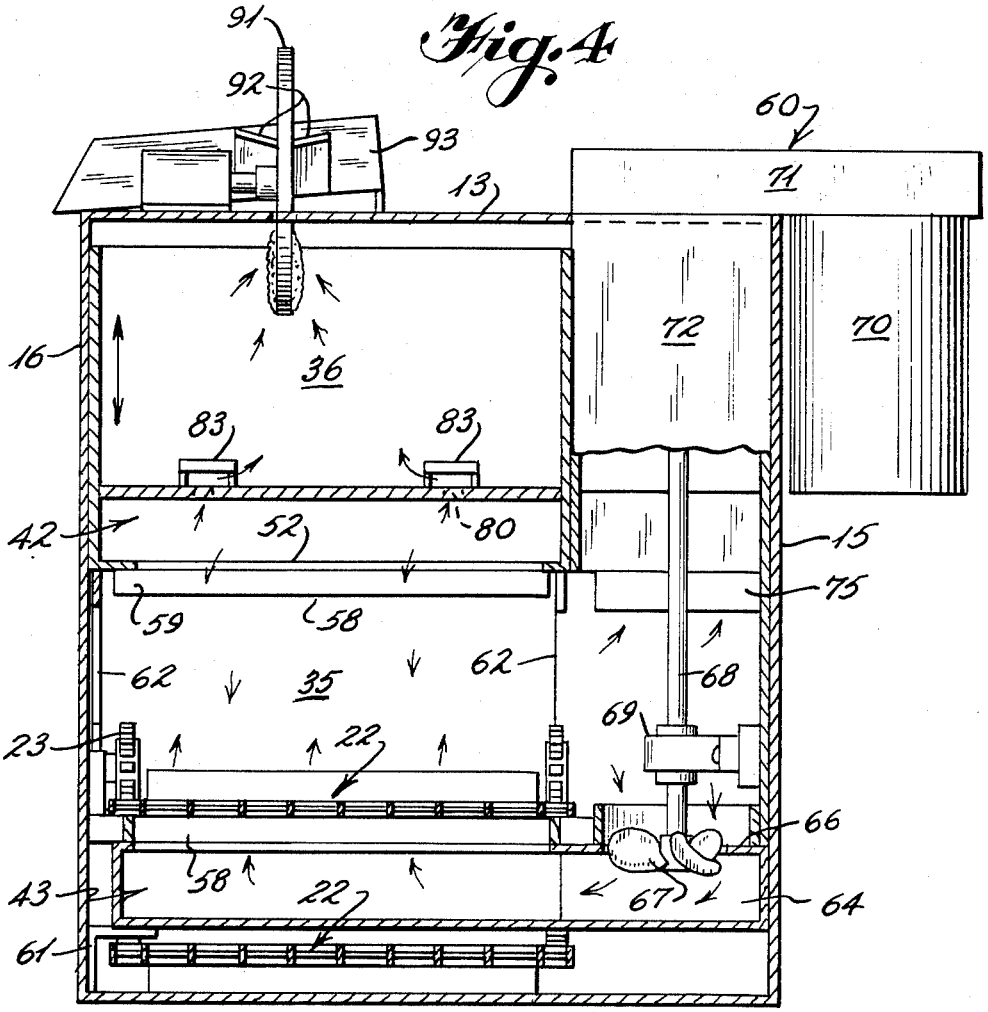
FIG. 4 is an enlarged cross sectional view having portions broken away taken along lines 4—4 of FIG. 1.

As previously discussed, the flow of degreasing and cleaning solution through the upper and lower headers is controlled by a pair of pump assemblies 50 and 60 each of which is associated with one of the headers. With particular reference to FIG. 4, the second or lower pump assembly 60 is shown in greater detail. The assembly includes an intake chamber 64 which is mounted in open fluid communication with a side wall of the lower header 43. The intake chamber includes a shroud 65 which surrounds an inlet opening 66. A propeller 67 is rotatably disposed within the opening 66 and is supported by an elongated vertically oriented drive shaaft 68. The drive shaft 68 is mounted adjacent the propeller in block or bearing assembly 69. The propeller is powered by a motor mounted within an outer enclosure 70 and which motor is drivingly connected to the drive shaft 68 by an intermediate drive element which is mounted within an intermediate housing 71. The upper end of the drive shaft may be enclosed in a secondary housing section 72 which extends upwardly through the upper wall of the machine housing. In operation, as propeller 67 is rotated, the cleaning solution will be forced through the opening 66 and into the lower header 43. The propeller will thereby create a pressurized flow of fluid outwardly of the openings 58 in the header. Appropriate controls may be provided for varying the rotational velocity of the propeller 67 thereby permitting the flow rate through the lower header to be selectively adjusted.

Figure 5:
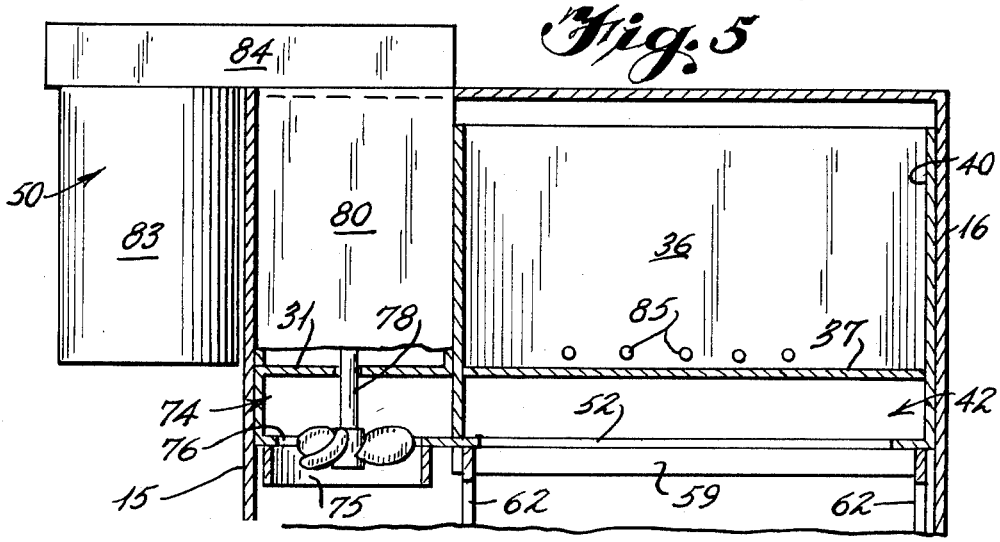
FIG. 5 is an enlarged cross sectional view having portions broken away taken along lines 5—5 of FIG. 1.

With reference to FIG. 5, the upper or first pump assembly 50 is shown as being mounted in cooperation with the upper header 42. The upper pump assembly includes an intake chamber 74 which is mounted in open fluid communication with the upper plenum through a side wall 45 thereof. A shroud 75 surrounds an inlet opening 76 into the intake chamber and a second propeller 77 is disposed within the opening 76. The propeller 77 is mounted on a vertically oriented drive shaft 78 which extends upwardly through a drive shaft enclosure 80 having a substantially closed end wall 81. The lower end of the drive shaft is guided within a bearing assembly (not shown). The drive shaft 78 is powered by a motor housed within a second outer enclosure 83 which is cantilevered outwardly from the drive shaft enclosure 80 by an intermediate housing 84. The connection between the motor, intermediate and propeller housings permits the entire pump assembly 50 to be vertically adjusted as the upper header is vertically adjusted as previously discussed. An intermediate drive element, such as a drive belt, is disposed through the intermediate housing 84 and connects the upper end of the drive shaft 78 with the second motor. As with the first propeller drive motor, controls may be provided for varying the speed of the drive shaft 78 so as to selectively change the rate of fluid flow generated by the propeller 77.

During the operation of the upper propeller 77, cleaning solution will be forced into the upper header and outwardly of the openings 52 therein so as to direct the cleaning fluid in currents or jets toward the upper run of the conveyor. It should be reiterated that both the upper and lower headers are fully submerged in the cleaning solution and therefore both propellers are also, immersed in the cleaning and degreasing solution. The high pressure fluid jets directed from the upper and lower headers will not only provide a high velocity fluid flow against opposite sides of articles or parts being transported by the conveyor but will also create an extremely turbulent environment within the cleaning chamber. Although not shown, one or more emmersion heaters may be mounted within the cleaning chamber and used to maintain the cleaning fluid at elevated temperatures to further facilitate the cleansing action within the machine.

The degreasing and cleaning machine not only provides equipment for effectively removing grease, oil, dirt and other contaminants from parts being transported therethrough but also includes structures for permitting the continuous removal of all such contaminants from the cleaning solution. In this manner, the same batch or charge of cleaning solution can be used over prolonged periods of time without adversely effecting the cleaning process.

The upper containment or separation chamber 36 is designed so that the fluid contained therein is retained relatively calm so that the contaminants such as grease and oil entrained in the cleaning solution may be separated by gravity due to the relative difference in the respective densities of the contaminants and the solution. The containment chamber is in fluid communication with the lower cleaning chamber 35 through weep or bleed holes 80 which extend through the lower wall 37 of the containment chamber. In this manner, a small portion of the fluid within the upper header will pass upwardly through the holes 80 and into the containment chamber. The holes are limited in number so as to limit the amount of fluid passing through the containment chamber and the holes are preferrably made in an area adjacent the discharge end of the machine or adjacent end wall 39 of the containment chamber. To further prevent the creation of any turbulence within the chamber, and as shown in FIG. *2b*, each of the bleed holes 80 is covered with a horizontal baffle 83 which serves to direct the fluid flow outwardly generally parallel with the fluid surface within the containment chamber.

The return of fluid or solution from the containment chamber is accomplished by way of small ports or openings 85 which are provided in the lower portion of the end wall 38. In this manner, the solution which has had the contaminants separated therefrom is introduced into the forward or feed end of the cleaning chamber 35.

As the grease, oil and other contaminants rise to the surface within the containment chamber, such contaminants are continuously removed by a skimming apparatus which is mounted to the upper wall 13 of the degreasing and cleaning machine housing 12. A slotted opening 90 is provided through the upper wall of the housing and a generally circular skimmer wheel 91 is rotatably mounted so as to extend downwardly within the containment chamber. As the skimmer wheel is rotated, the contaminants including greases and oils will adhere to the opposite side thereof, and as the skimmer wheel rotates above the housing 12, both sides thereof will be engaged by opposing scrapers 92. The scrapers are shaped so as to not only remove the contaminants from the skimmer wheel but also to convey such contaminants to a common trough 93. From the trough 93, the contaminants will be channeled to adjacent storage receptacles or containers.

In the operation of the degreasing and cleaning machine of the present invention, the parts which are to be treated may either be placed on the intake section of the conveyor or may be continuously fed thereto by other conveying machinery. Parts are carried by the conveyor into the cleaning chamber which is substantially filled with the cleaning solution so that the parts are totally submerged as they pass therethrough. Within the cleaning chamber 36, the parts will be agitated and directly impacted by the opposing streams or currents of cleaning solution which are being directed out of the elongated openings or nozzles 52 and 58 which are provided in the upper and lower headers 42 and 43, respectively. The turbulent cleaning action is continued throughout the length of the cleaning chamber and thereafter the parts are transported through the discharge end of the machine at which point the parts are transferred to other conveying equipment or awaiting containers.

During the continued operation of the degreasing and cleaning machine, the contaminants which have been removed from the parts passing therethrough will be removed from solution by allowing a portion of the cleaning solution to be bled from the upper header 42 into a non-turbulent containment area 36. Within the non-turbulent containment area, the oils, greases and other contaminants will be allowed to separate from solution and float to the surface where such contaminants are withdrawn by the skimmer apparatus. The processed cleaning solution is thereafter allowed to flow back into the cleaning chamber in such a manner that a continuous supply of regenerated cleaning solution is continuously available.

As the upper header is vertically adjustable with respect to the conveyor, it is possible to selectively space the upper header from the conveyor to facilitate the handling of varying sizes of parts or components being cleaned. In addition, the amount of turbulence created within the cleaning chamber may be regulated by adjusting the flow rate through the propellers associated with the intakes to each of the upper and lower headers.

I claim:

1. A degreasing and cleaning machine for cleaning parts and other articles comprising a housing having an inlet end, a discharge end and an intermediate fluid retention portion, a cleaning chamber defined within said housing and spaced vertically below said inlet end and said discharge end thereof, upper and lower headers mounted within said cleaning chamber of said housing so as to be in spaced vertical relationship with respect to one another, each of said upper and lower headers having a plurality of discharge opening therein which are oriented in opposing relationship with respect to one another, a first fluid inlet opening into said upper header, a second fluid inlet opening in said lower header, fluid flow control means for circulating fluid from within said cleaning chamber through said first inlet opening to said upper header and out of said discharge openings therein and through said second fluid inlet opening and through said discharge openings in said lower header, a contaminant containment chamber mounted in fluid communication with said intermediate fluid retention portion of said housing, means mounted to said housing for removing contaminants from said containment chamber, and conveyor means mounted within said housing and extending from said inlet end to said discharge end thereof, said conveyor means extending through said cleaning chamber so that a section thereof extends between said upper and lower headers whereby parts carried by said conveyor means are carried through said cleaning chamber and acted upon by opposing fluid currents being directed through said discharge openings in said upper and lower headers.

2. A degreasing and cleaning machine for cleaning parts and other articles comprising a housing having an inlet end, a discharge end and an intermediate fluid retention portion, a cleaning chamber defined within said housing and spaced vertically below said inlet end and said discharge end thereof, upper and lower headers mounted within said cleaning chamber of said housing so as to be in spaced vertical relationship with respect to one another, each of said upper and lower headers having a plurality of discharge openings therein which are oriented in opposing relationship with respect to one another, a first fluid inlet opening into said upper header and first fluid flow control means for circulating fluid from within said cleaning chamber through said inlet opening and out of said discharge openings therein, a second fluid inlet opening in said lower header and second fluid flow control means for circulating fluid from within said cleaning chamber through said second opening and through said discharge openings in said lower header, and conveyor means mounted within said housing and extending from said inlet end to said discharge end thereof, said conveyor means extending through said cleaning chamber so that a section thereof extends between said upper and lower headers, a contaminant containment chamber mounted within said intermediate portion of said housing and vertically spaced above said upper header, said containment chamber having a lower wall and side wall and end wall portions, at least one opening between said upper header and said containment chamber remote from said first opening for permitting a flow of fluid between said containment chamber and said cleaning chamber, means mounted to said intermediate portion of said housing for removing contaminants from said containment chamber, whereby parts carried by said conveyor means are carried through said cleaning chamber and acted upon by opposing fluid currents being directed through said discharge openings in said upper and lower headers.

3. The degreasing and cleaning machine of claim 2 in which said at least one opening between said upper header and said containment chamber extends through said lower wall of said containment chamber, and baffle means mounted within said containment chamber and above said at least one opening to direct the flow of fluid passing therethrough generally horizontally with respect to the surface of the fluid contained therein.

4. The degreasing and cleaning machine of claim 3 in which said at least one opening between said upper header and said containment chamber are disposed through said bottom wall of said containment chamber adjacent said discharge end of said housing and said at least one second opening in said containment chamber is provided through an end wall adjacent said inlet end of said housing.

5. The degreasing and cleaning machine of claim 4 in which said means for removing contaminants from said containment chamber includes a generally circular skimmer wheel which is mounted to said intermediate portion of said housing so that a portion thereof extends within the fluid within said containment chamber, said skimmer wheel having substantially planar opposite sides, first and second scraper means mounted on opposite sides of said skimmer wheel so as to engage said opposite sides thereof, and trough means associated with said first and second scraper means to convey contaminants removed from said skimmer wheel by said scraper means to a remote location.

6. The degreasing and cleaning machine of claim 2 in which said conveyor means is a continuous belt conveyor having upper and lower runs, said continuous belt conveyor being of generally open porous construction.

7. The degreasing and cleaning machine of claim 6 in which said upper run of said continuous belt conveyor is disposed between said upper and lower headers and said lower run is returned beneath said lower header and within said housing.

8. The degreasing and cleaning machine of claim 7 including a plurality of spaced and transversely oriented outwardly extending flange means secured to said conveyor means.

9. The degreasing and cleaning machine of claim 6 in which said plurality of openings in said upper and lower headers include elongated slots which extend substantially across the width of said upper and lower headers, said slots being oriented generally perpendicularly with respect to the path of travel of said conveyor means, said elongated slots being spaced with respect to one another along the length of said upper and lower headers.

10. The degreasing and cleaning machine of claim 9 in which said upper and lower headers are further defined by flange means which extend along the opposite sides of said slots so as to form generally elongated nozzles for directing the flow of fluid from said upper and lower headers vertically toward said section of said conveyor means.

11. The degreasing and cleaning machine of claim 6 including means for adjustably supporting said upper header with respect to said section of said conveyor means whereby said upper header may be selectively vertically spaced with respect thereto.

12. The degreasing and cleaning machine of claim 6 in which said fluid flow control means includes a first propeller means mounted within said first fluid inlet opening into said upper header and said second fluid flow control means includes a second propeller means mounted within said second fluid inlet opening into said lower header, first drive shaft means supporting said first propeller means and second drive shaft means for supporting said second propeller means, a first drive means for driving said first drive shaft means, and second drive means for driving said second drive shaft means.

13. The degreasing and cleaning machine of claim 12 in which each of said upper and lower headers includes an auxiliary inlet chamber mounted in fluid communication therewith, said first and second fluid inlet openings into said upper and lower headers being provided in said auxiliary chambers.

14. The degreasing and cleaning machine of claim 13 including support means for adjustably supporting said upper header so that said upper header is selectively vertically spaced relative to said section of said conveyor means.

15. A degreasing and cleaning machine for cleaning parts and other articles comprising a housing having an inlet end, a discharge end and an intermediate fluid retention portion, a cleaning chamber defined within said housing and spaced vertically below said inlet end and said discharge end thereof, upper and lower headers mounted within said cleaning chamber of said housing so as to be in spaced vertical relationship with respect to one another, each of said upper and lower headers having a plurality of discharge openings therein which are oriented in opposing relationship with respect to one another, a first fluid inlet opening into said upper header and first fluid flow control means for circulating fluid from within said cleaning chamber through said inlet opening and out of said discharge openings therein, a second fluid inlet opening in said lower header and second fluid flow control means for circulating fluid from within said cleaning chamber through said second opening and through said discharge openings in said lower header, a contaminant containment chamber mounted within said intermediate portion of said housing and vertically spaced above said upper header, said containment chamber having a lower wall and side wall and end wall portions, at least one opening between said upper header and said containment chamber so as to permit a flow of fluid therebetween, at least one second opening in said containment chamber remote from said first opening for permitting a flow of fluid between said containment chamber and said cleaning chamber, and means for removing contaminants from said containment chamber, a continuous belt conveyor means mounted within said housing and extending from said inlet end to said discharge end thereof, said conveyor means having upper and lower runs and being of generally open porous construction, said upper run of said conveyor means being disposed between said upper and lower headers within said cleaning chamber whereby parts carried by said conveyor means are carried through said cleaning chamber and acted upon by opposing fluid currents being directed through said discharge openings in said upper and lower headers.

16. The degreasing and cleaning machine of claim 15 including means for adjustably supporting said upper header with respect to said upper run of said conveyor means whereby said upper header may be selectively vertically spaced with respect thereto.

17. The degreasing and cleaning machine of claim 16 in which said plurality of openings in said upper and lower headers include elongated slots which extend substantially across the width of said upper and lower headers, said slots being oriented generally perpendicularly with respect to the path of travel of said conveyor means, said elongated slots being spaced with respect to one another along the length of said upper and lower headers, and flange means which extend along the opposite sides of said slots so as to form generally elongated nozzles for directing the flow of fluid from said upper and lower headers vertically toward said upper run of said conveyor means.

18. A degreasing and cleaning machine for cleaning parts and other articles comprising a housing having an inlet end, a discharge end and an intermediate fluid retention portion, a cleaning chamber defined within said housing and spaced vertically below said inlet end and said discharge end thereof, upper and lower headers mounted within said cleaning chamber of said housing so as to be in spaced vertical relationship with respect to one another, each of said upper and lower headers having a plurality of discharge opening therein which are oriented in opposing relationship with respect to one another, a first fluid inlet opening into said upper header and first fluid flow control means for circulating fluid from within said cleaning chamber through said inlet opening and out of said discharge openings therein, a second fluid inlet opening in said lower header and second fluid flow control means for circulating fluid from within said cleaning chamber through said second opening and through said discharge openings in said lower header, a contaminant containment chamber mounted in fluid communication with said intermediate fluid retention portion of said housing, means mounted to said housing for removing contaminants from said containment chamber, a conveyor means mounted within said housing and extending from said inlet end to said discharge end thereof, said conveyor means being of generally open porous construction and having a run disposed between said upper and lower headers within said cleaning chamber, whereby parts carried by said conveyor means are carried through said cleaning chamber and acted upon by opposing fluid currents being directed through said discharge openings in said upper and lower headers.

19. The degreasing and cleaning machine of claim 18 in which said plurality of openings in said upper and lower headers include elongated slots which extend substantially across the width of said upper and lower headers, said slots being oriented generally perpendicularly with respect to the path of travel of said conveyor means, said elongated slots being spaced with respect to one another along the length of said upper and lower headers.

20. The degreasing and cleaning machine of claim 18 in which said fluid flow control means includes a first propeller means mounted within said first fluid inlet opening into said upper header and said second fluid flow control means includes a second propeller means mounted within said second fluid inlet opening into said lower header, first drive shaft means supporting said first propeller means and second drive shaft means for supporting said second propeller means, a first drive means for driving said first drive shaft means, and second drive means for driving said second drive shaft means.

21. The degreasing and cleaning machine of claim 20 in which said contaminant containment chamber is mounted within said intermediate portion of said housiong and vertically spaced above said upper header, said containment chamber having a lower wall and side wall and end wall portions, at least one opening between said upper header and said containment chamber so as to permit a flow fo fluid therebetween, at least one second opening in said containment chamber remote from said first opening for permitting a flow of fluid between said containment chamber and said cleaning chamber, and means mounted to said intermediate portion of said housing for removing contaminants from said containment chamber.

22. The degreasing and cleaning machine of claim 18 including means for adjustably supporting said upper header with respect to said run of said conveyor means so that said upper header may be selectively vertically spaced with respect thereto.

* * * * *